US006149117A

United States Patent [19]

Shao

[11] Patent Number: 6,149,117

[45] Date of Patent: Nov. 21, 2000

[54] DECORATIVE AND FUNCTIONAL FIXTURE AS SHEETLIKE OBJECT HANGER

[76] Inventor: Dan Shao, 1826 Chantry Dr., Arcadia, Calif. 91006

[21] Appl. No.: 09/349,800

[22] Filed: Jul. 9, 1999

[51] Int. Cl.[7] ..... A47G 1/10

[52] U.S. Cl. ..... 248/316.3; 248/205.3; 24/488; 24/522; 24/67 R; 40/617; 40/611; 40/658

[58] Field of Search ..... 248/316.3, 316.7, 248/316.1, 683, 205.3, 205.5, 206.5; 211/89, 45; 24/488, 522, 526, 67 R; 40/617, 757, 611, 658

[56] References Cited

U.S. PATENT DOCUMENTS

| | | | |
|---|---|---|---|
| 1,618,901 | 2/1927 | Woolman | 24/488 |
| 1,843,023 | 1/1932 | Edmondson | 24/526 |
| 2,231,883 | 2/1941 | Caccivio | 248/316.3 |
| 2,377,488 | 6/1945 | Fugazzi | 248/316.3 |
| 3,591,013 | 7/1971 | Herrmann | 248/316.3 |
| 4,085,848 | 4/1978 | Tsuge | 211/45 |
| 5,170,982 | 12/1992 | Schultheis et al. | 248/316.3 |

FOREIGN PATENT DOCUMENTS

| | | | |
|---|---|---|---|
| 2451491 | 11/1980 | France | 248/316.3 |

*Primary Examiner*—Anita M. King
*Assistant Examiner*—Gwendolyn Baxter
*Attorney, Agent, or Firm*—Raymond Y. Chan; David and Raymond

[57] ABSTRACT

A decorative and functional fixture, which is capable of functioning as a sheetlike object hanger for vertically holding sheetlike objects, includes a front fixture having a substantially flat supporting surface at a rear side, wherein at least a rail groove is vertically extended on the supporting surface; at least a holding ball, which is rotatably disposed in the respective rail groove; and a rear supporting panel, which is integrally connected to the rear side of the front fixture, having a front holding surface extending behind the rail groove and the supporting surface to define a holding gap between the front holding surface and the supporting surface means and a back surface for mounting the rear supporting panel onto a vertical or slanted supporting surface. Whereby, the holding ball will move upward and inward into the rail groove when a sheetlike object is slidably placed up and into the holding gap. Due to gravity, the holding ball will return to its normally rest position again, i.e. the bottom end of the rail groove, to press the sheetlike object against the front holding surface of the rear supporting panel.

2 Claims, 8 Drawing Sheets

DECORATIVE AND FUNCTIONAL FIXTURE AS SHEETLIKE OBJECT HANGER

FIELD OF THE PRESENT INVENTION

The present invention relates to decorative and functional fixtures, such as door sign, door knocker, lamp base, wall mounted front fixture, and wall hanger, and more particularly to a front fixture that can additionally functioned as a sheetlike object hanger for hanging flat and sheetlike objects such as pictures, thin cloth or papers, wherein the sheetlike object will be held more firmly due to the gravity.

BACKGROUND OF THE PRESENT INVENTION

All kinds of decorative and functional fixtures, such as door sign, doorknocker, lamp base, wall mounted front fixture, and wall hanger, are commonly used in residence houses and office buildings. However, each of such decorative or functional fixtures contains a single designated function only or is merely for decorative purpose.

Besides, typically, when one needs to leave an important message, one writes it on a piece of paper. Then, the writer must find a conspicuous place to leave the message, such as a wall, a door, or a computer, i.e. usually a place where the message can be displayed vertically for easy noticing. Conventionally, there are any numbers of ways of doing this. Using tape, stapling the paper, or putting it in some kind of spring loaded grip attached to the wall, door, etc.

The same circumstances occur when one has a picture to be displayed. A vertical location is found, and then a means for placing the picture at the vertical location is found. Similarly, in some locations, one needs to hang a towel, simply, quickly and easily.

In all such cases, not only is finding a place important, but often, because of the location, the means for hanging the note, picture, or towel must also have an aesthetic appearance. A piece of tape attaching a note to a door; a metal spring grip holding a picture on the side of a computer; or a door knob doubling as a towel hanger; all these methods may be functional, but are disfavored because they are aesthetically not pleasing.

Functionally, another problem with conventional holding means of attaching the aforementioned items is damage to the item. For example, using tape to hold a piece of paper ruins the paper if it is removed, and gripping a picture so tightly with any kind of grip may crease the picture. The conventional method for holding a towel is to hang it on a towel rack, where the towel often ends up falling off and onto the floor.

Practically, all conventional holding means are used for holding a sheetlike object such as message paper, picture or towel against gravity. In other words, the more heavy of the sheetlike object to be hanged, the more holding force must be applied thereto by the holding means. Therefore, these types of vertical holders lack qualities that provide simple functionality and aesthetics.

SUMMARY OF THE PRESENT INVENTION

The main object of the present invention is to provide a decorative and functional fixture that can be functioned as a sheetlike object hanger for vertically hanging at least one sheetlike object against a vertical surface without affecting the integrity of the sheetlike object.

Another object of the present invention is to provide a decorative and functional fixture that can be functioned as a sheetlike object hanger to firmly hang a sheetlike object in position by means of gravity while no complicated mechanical mechanism is included.

Another object of the present invention is to provide a decorative and functional fixture functioned as a sheetlike object hanger that allows easy removal of the sheetlike object when removal of the sheetlike object is desired, and provides an aesthetic, decorative appearance allowing use of the present invention in a multitude of places, i.e. any place which has a vertical, or slanted flat surface.

Accordingly, in order to accomplish the above objects, the present invention provides a decorative and functional fixture that is capable of functioning as a sheetlike object hanger for vertically holding sheetlike objects, wherein the decorative and functional fixture comprises:

a front fixture having a substantially flat supporting surface at a rear side, wherein at least a rail groove is vertically extended on the supporting surface, the rail groove having a deeper recessed area at a top end, a shallower recessed area at a bottom end, and a slopping groove surface extending between the top end and the bottom end so as to define a slopping depth gradually increasing from the bottom end to the top end;

at least a holding ball, which is rotatably disposed in the respective rail groove and capable of rolling along the slopping groove surface, having a diameter larger than the shallower recessed area at the bottom end of the rail groove;

a rear supporting panel, which is integrally connected to the rear side of the front fixture, having a front holding surface extending behind the rail groove and the supporting surface to define a holding gap between the front holding surface of the rear supporting panel and the supporting surface of the front fixture, wherein the holding gap opens at a bottom and two sides thereof and has a width smaller than the diameter of the holding ball, thereby a weight of the holding ball normally renders the holding ball positioning at the lower end of the rail groove and pressing against both the slopping groove surface thereof and the front holding surface of the rear supporting panel by means of gravity; and a means for mounting the rear supporting panel onto a vertical or slanted supporting surface.

Whereby, the holding ball will move upward and inward into the rail groove when a sheetlike object is slidably placed up and into the holding gap. Due to gravity, the holding ball will return to its normally rest position again, i.e. the bottom end of the rail groove, to press the sheetlike object against the front holding surface of the rear supporting panel.

Any downward force applied on the sheetlike object will only relatively pull the holding ball downwards to exert greater holding pressure on the sheetlike object restraining the sheetlike object in the holding gap against the front holding surface of the rear supporting panel. However, simply applying a sideward force on the sheetlike object can cause the holding ball to rotate allowing the sheetlike object to be slidably removed from the holding gap horizontally.

DETAILED DESCRIPTION OF THE PREFERRED EMBODIMENT

Figure 1A:
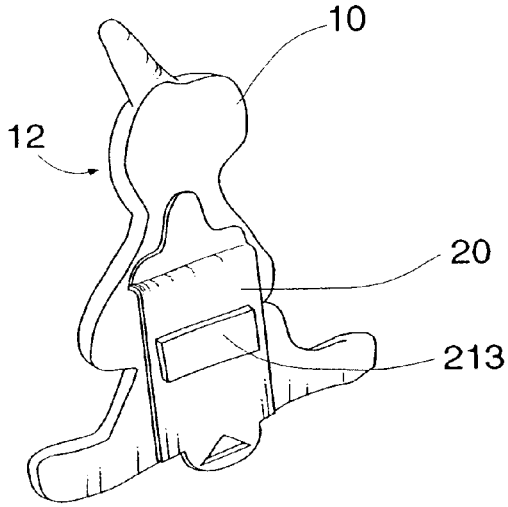
FIG. 1*a* is a rear perspective view of a decorative and functional fixture functioned as a sheetlike object hanger according to a first preferred embodiment of the present invention.
Figure 1B:
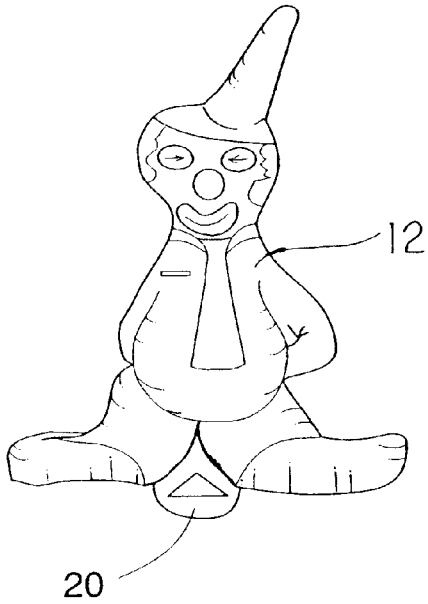
FIG. 1*b* is a front view of the decorative and functional fixture functioned as a sheetlike object hanger according to the above first preferred embodiment of the present invention.
Figure 2:
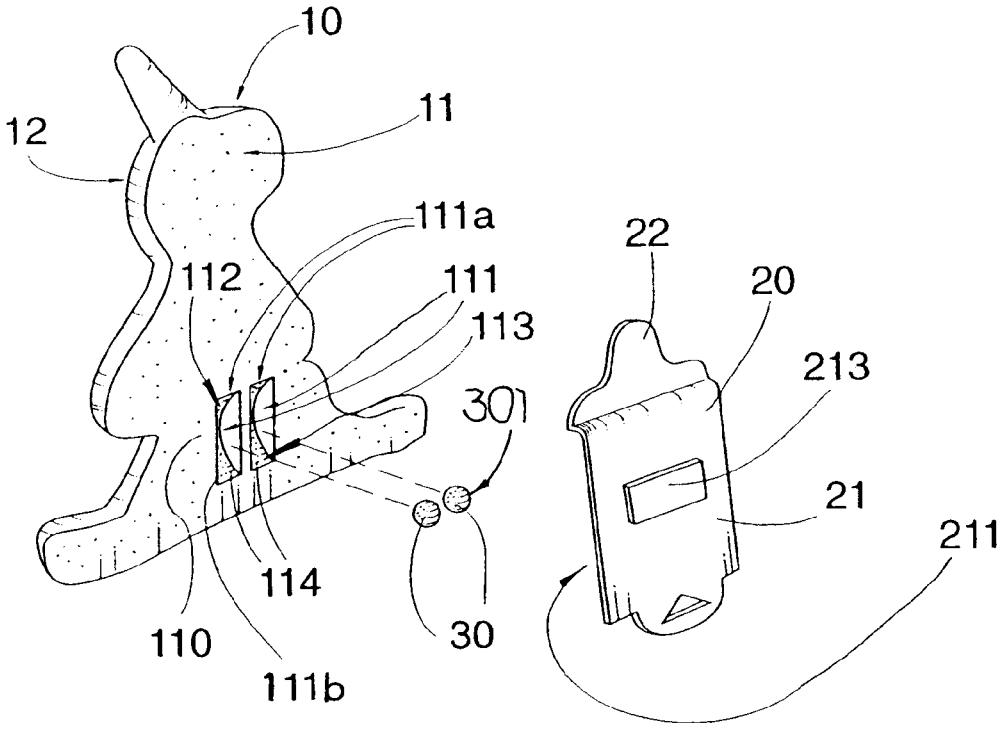
FIG. 2 is an exploded perspective view of the decorative and functional fixture according to the above first preferred embodiment of the present invention.
Figure 3:
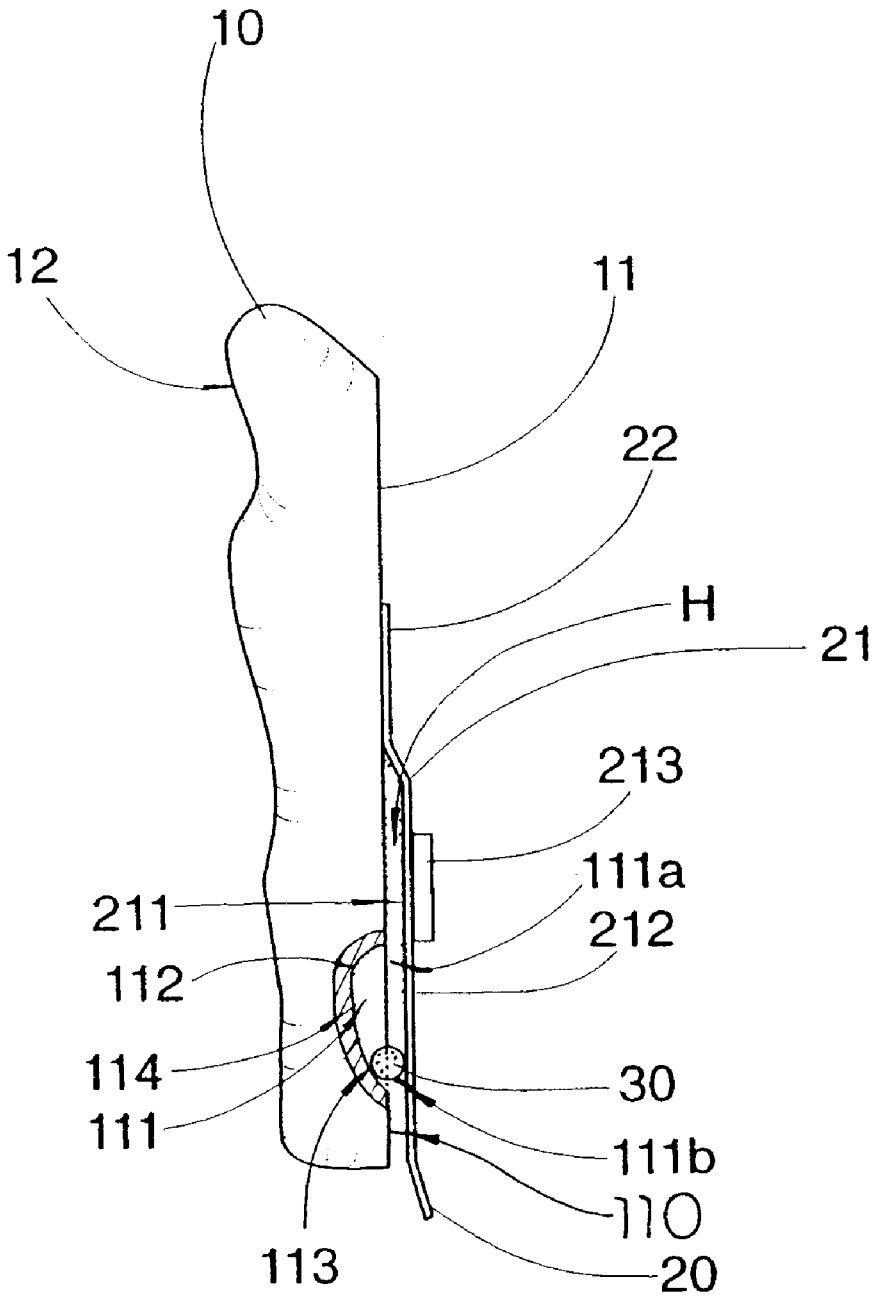
FIG. 3 is a partial sectional side view of the decorative and functional fixture according to the above first preferred embodiment of the present invention.
Figure 4A:
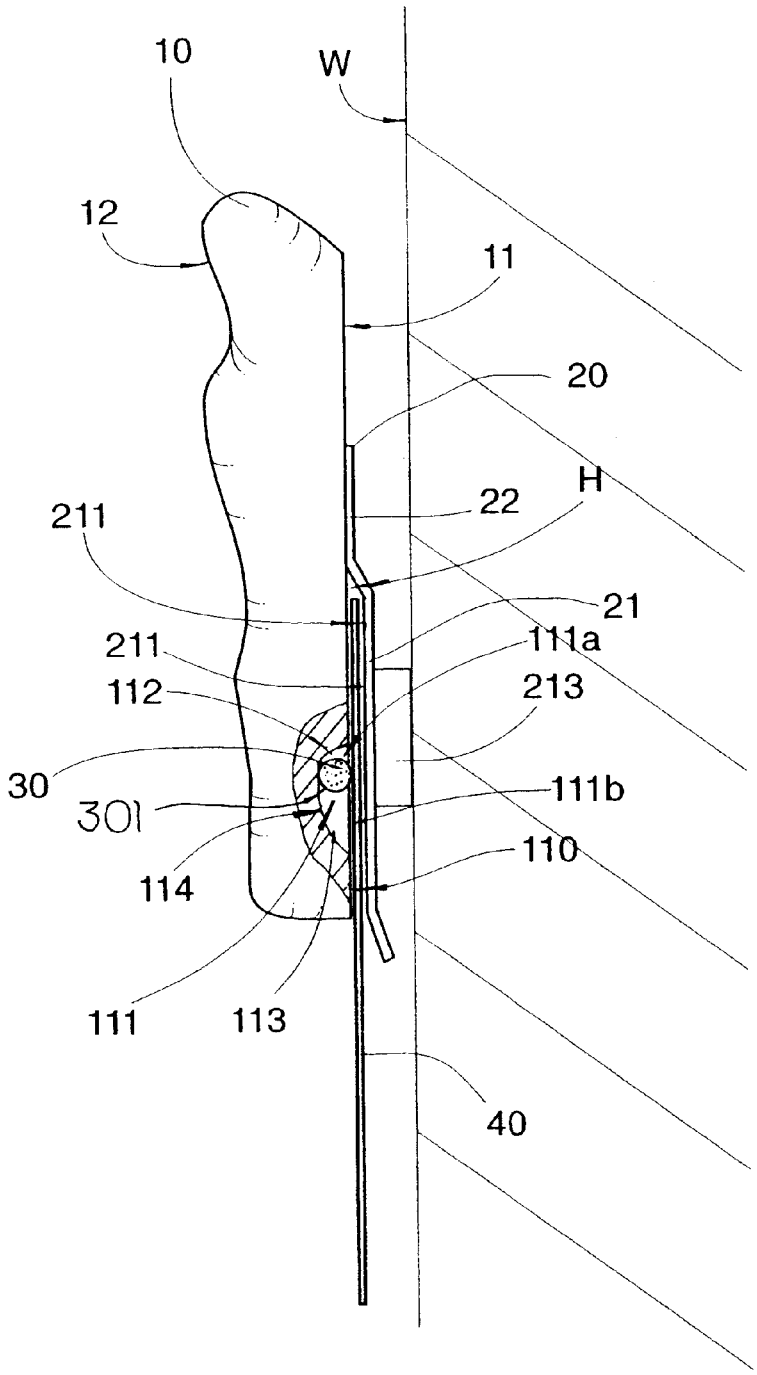
FIG. 4*a* is a partial sectional side view of the decorative and functional fixture according to the above first preferred embodiment of the present invention, illustrating how a sheetlike object slidably inserted into the holding gap thereof.
Figure 4B:
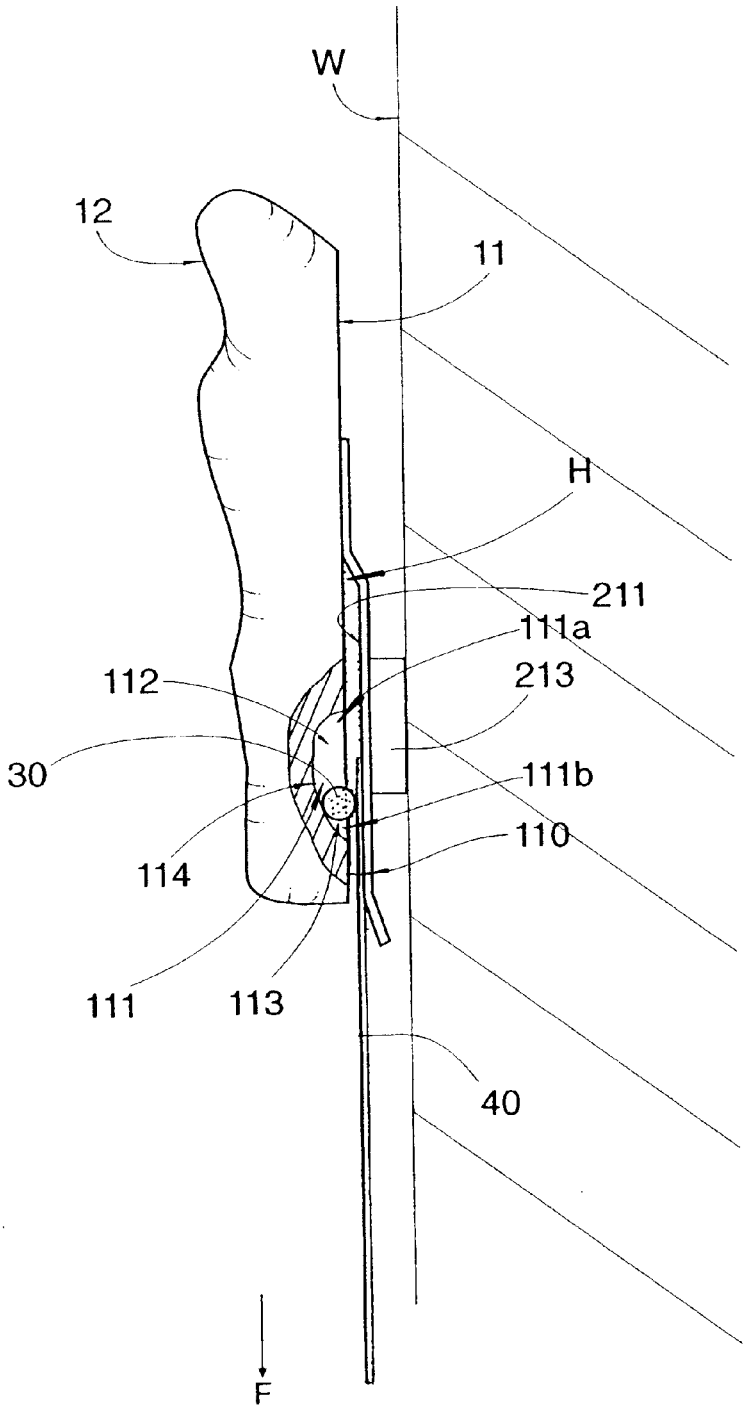
FIG. 4*b* is a partial sectional side view of the decorative and functional fixture according to the above first preferred embodiment of the present invention, illustrating how a sheetlike object being hanged in the holding gap thereof.

Referring to FIGS. 1*a* to 4B of the drawings, a decorative and functional fixture that can additionally functioned as a sheetlike object hanger according to a preferred embodiment of the present invention is illustrated. The decorative and functional fixture comprises a front fixture 10, a rear supporting panel 20, at least a holding ball 30, and a mounting means 213 for attaching the rear supporting panel 20 onto a vertical or slanted supporting surface W (as shown in FIGS. 4A and 4B).

The front fixture 10 has a substantially flat supporting surface 110 at a rear side 11, wherein at least a rail groove 111 is vertically extended on the supporting surface 110. According to the first preferred embodiment as shown in FIG. 2, a pair of rail grooves 111 are provided for dual holding power. Each of the rail grooves 111 has a deeper top recessed area 112 at a top end 111*a*, a shallower bottom recessed area 113 at a bottom end 111*b*, and a slopping groove surface 114 extending between the top end 111*a* and the bottom end 111*b* so as to define a slopping depth gradually increasing from the bottom end 111*b* to the top end 111*a*. Moreover, a pair of holding balls 30 are rotatably disposed in the two rail grooves 111 respectively, wherein each of the holding balls 30 is capable of rolling along the slopping groove surface 114 and has a diameter larger than the shallower recessed area 113 at the bottom end 111*b* of the rail groove 111.

The rear supporting panel 20, which is integrally connected to the rear side 11 of the front fixture 10, has a front holding surface 211 extending behind the rail grooves 111 and the supporting surface 110 to define a holding gap H between the front holding surface 211 of the rear supporting panel 20 and the supporting surface 110 of the front fixture 10, wherein the holding gap H opens at a bottom and two sides thereof and has a width smaller than the diameter of the holding ball 30, thereby the weight of each of the holding balls 30 normally renders the holding ball 30 positioning at the lower end 111*b* of the rail groove 111 and pressing against both the slopping groove surface 114 thereof and the front holding surface 211 of the rear supporting panel 20 by means of gravity.

According to the first preferred embodiment as shown in FIGS. 1 to 4B, the front fixture 10 and the rear supporting panel 20 are made of rigid material. The rear supporting panel 20 comprises a holding panel 21, which has a front surface acting as the front holding surface 211 and a back surface 212, and an affixing member 22 which is upwardly and inwardly extended from the holding panel 21 for attaching to the rear side 11 of the front fixture 10, so as to position the holding panel 21 parallelly right behind the supporting surface 110 and the rail grooves 111 provided on the supporting surface 110, wherein the holding gap H having a width less than the diameter of the holding ball 30 must be defined between supporting surface 10 and the front holding surface 211.

The affixing member 22 can be affixed to the rear side 11 of the front fixture 10 by screwing, gluing, welding, or riveting, etc. The mounting means 213 comprises an adhesive pad 213 having an inner side attached to the back surface 212 of the holding panel 21 and an outer side adapted for adhering on the vertical or slanted supporting surface W (as shown in FIGS. 4A and 4B) of a stationary object such a wall, a refrigerator, or a door.

As shown in FIGS. 2, 3, 4A, and 4B, the slopping groove surface 114 of each of the rail grooves 111 is an inclined surface. In other words, each of the rail grooves 111 is a concave groove defining the deeper top recessed area 112 and the shallower bottom recessed area 113. The two holding balls 30 respectively sit in the two rail grooves 111 which are adapted to guide the up and down movement of the two holding balls 30.

As illustrated in FIG. 3, when the decorative and functional fixture that can be functioned as a sheetlike object hanger is not in use, the weight of the two balls 30 will drive the balls 30 sitting in the shallower bottom recessed areas 113 of the rail grooves 111 respectively, wherein part of the ball 30 rest in the shallower bottom recessed area 113 while part of the ball 30 extend in the holding gap H. In such a resting position, the ball 30 press against the respective slopping groove surface 114 of the rail groove 111 and the front holding surface 211 of the rear supporting panel 20.

However, according to the present invention, as shown in FIG. 4A, the holding balls 30 are capable of moving upward and inward into the rail groove when a sheetlike object 40, such as a piece of paper or a towel, is upwardly and slidably inserted into the holding gap H. Due to gravity, the holding balls 30 will trend and return to their normally rest position again, i.e. the bottom end 111*b* of the rail groove 111, to press the sheetlike object 40 against the front holding surface 211 of the rear supporting panel 20.

When one or more of the sheetlike objects 40, each having a thickness thinner than the holding gap H, are upwardly inserted into the holding gap H through the bottom opening of the holding gap H, the upward movement of the top edge of the sheetlike object 40 will first push up the holding balls 30 towards the deeper top recessed areas 112 of the rail grooves 111. Therefore, the sheetlike object 40 can slidably pass between the holding balls 30 and the front holding surface 211 of the rear supporting panel 20. Once the upwardly pushing force of the sheetlike object 40 stops, the holding balls 30 will fall down due to gravity to press the sheetlike object 40 against the front holding surface 211 so as to grip the sheetlike object 40 to be hanged by the decorative and functional fixture. The heavier of the sheetlike objects or the larger of the downward pulling force applied to the sheetlike objects will relatively increase the gripping force of the holding balls 30 against the front holding surface 211 so as to more firmly hold the sheetlike objects 40 in hanging position.

In other words, as shown in FIG. 4B, any downward force F applied on the sheetlike object 40, including its own weight, will generate additional torque on the holding balls 30 to relatively pull the holding balls 30 to move downwards to exert greater holding pressure on the sheetlike object 40 restraining the sheetlike object 40 in the holding gap H against the front holding surface 211 of the rear supporting panel 20.

However, simply applying a sideward force on the sheetlike object 40 can cause the holding balls 30 to rotate allowing the sheetlike object 40 to be slidably removed from the holding gap H horizontally. In other words, a sideways pressure on the sheetlike object 40 does not create any pressing pressure from the holding ball 30 and the sheetlike object 40 may therefore be slidably removed from the decorative and functional fixture.

As shown in FIGS. 1 to 4B, a front side 12 of the front fixture 10 can be a sculpture, a cartoon or any other decorative shape or sign for display or use. In view of above, by incorporating the rear supporting panel 20 with the rail grooves 111 and the holding balls 30 substantially construct a sheetlike object hanger mechanism for the front fixture 10.

Figure 5:
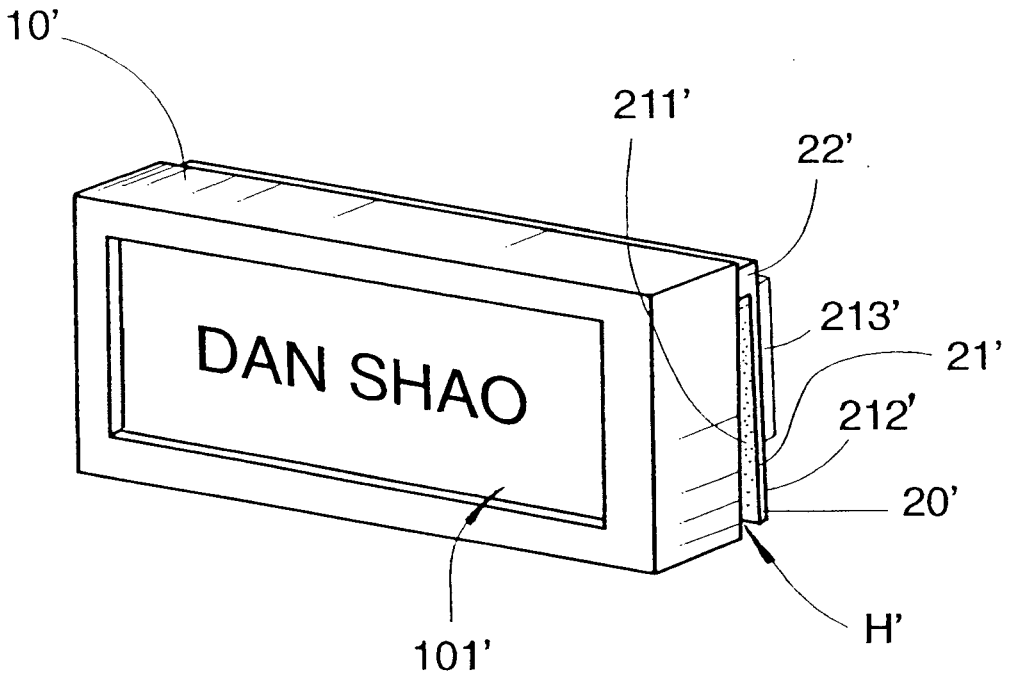
FIG. 5 is a front perspective view of a decorative and functional fixture functioned as a sheetlike object hanger according to a second preferred embodiment of the present invention.

Practically, the decorative and functional fixture of the present invention can also be any other utility fixture such as a picture frame or a door sign as shown in FIG. 5. The decorative and functional fixture, as shown in FIG. 5, according to a second preferred embodiment of the present invention is a door sign which comprises a rectangular front fixture 10' having a front displacing surface 101' for printing a person's name or other indication such as "conference room" or for attaching an indication card thereto.

Figure 6:
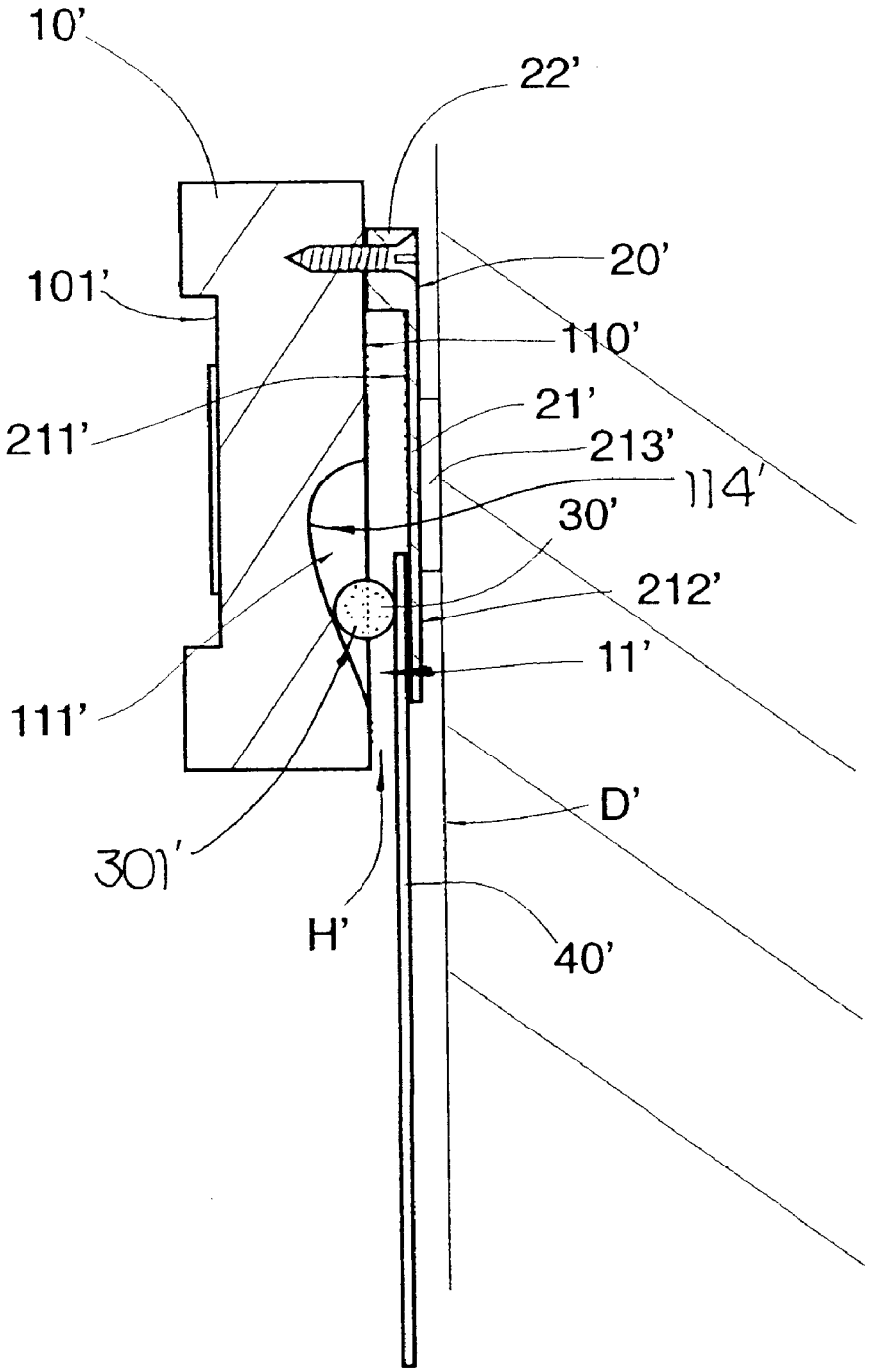
FIG. 6 is a sectional side view of the decorative and functional fixture according to the above second preferred embodiment of the present invention.

As shown in FIGS. 5 and 6, similar to the above first preferred embodiment, a sheetlike object hanger mechanism is also constructed by incorporating a rear supporting panel 20' with at least a holding ball 30' slidably and rotatably rest in at least a slopping rail groove 111' indented on a supporting surface 110' of a rear side 11' of the front fixture 10'. The rear supporting panel 20' comprises a holding panel 21' and an affixing member 22' frontwarly projected along a top edge of the holding panel 21' for affixing to the rear side 11' of the front fixture 10' so as to enable the holding panel 21' parallelly positioned behind the supporting surface 110' and the rail groove 111' to define a holding gap H' between the front holding surface 211' and the supporting surface 111'. A mounting means 213' is provided on a rear surface 212' of the rear supporting panel 20' for attaching on a door D'. So that the decorative and functional fixture as illustrating in FIGS. 5 and 6 of the second preferred embodiment not only can normally works as a door sign but also can be functioned as a sheetlike object hanger to hold sheetlike object 40' such as message papers or incoming fax by inserting a top portion of the sheetlike object 40' into the holding gap H', wherein the sheetlike object 40' will be firmly gripped between the holding ball 30' and the holding panel 21'.

Figure 7:
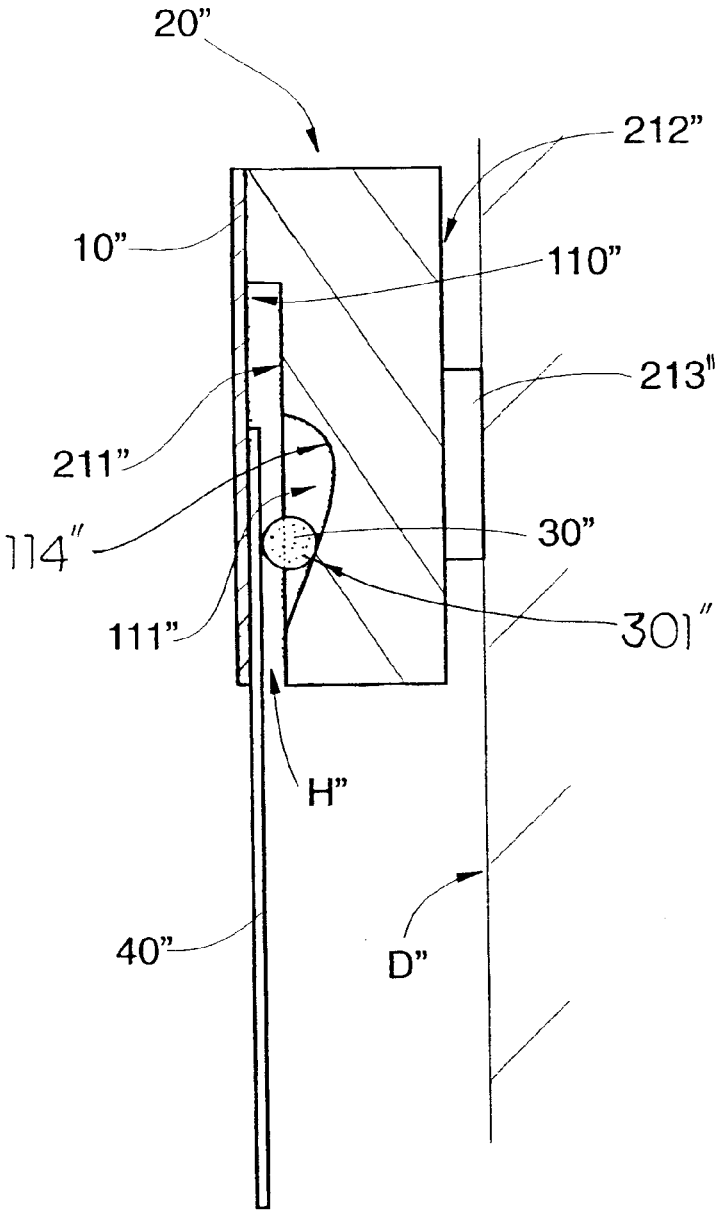
FIG. 7 is a sectional side view of an alternative mode of the present invention.

It must be emphasized that it is an obvious to modify the above embodiments by having a thinner front fixture 10 or 10' and a thicker rear supporting panel 20 or 20', as shown in FIG. 7, wherein the rail grooves 111" is provided on the front holding surface 211" of the rear supporting panel 20" to receive the holding ball 30", wherein the rear surface 212" of the rear supporting panel 20" is attached to a wall D" by the mounting means 213". Such alternative works identical to the above embodiments that a sheetlike object 40" can be hanged between the holding ball 30" and the supporting surface 110" of the front fixture 10" within the holding gap H ". Moreover, the surface 310, 301', 301" of the holding ball 30, 30', 30", the slopping groove surface 114, 114', 114", the supporting surface 110, 110', 110" and/or the front holding surface 211, 211', 211" can be a rough surface to increase friction.

What is claimed is:

1. A decorative and functional fixture that is capable of functioning as a sheetlike object hanger for vertically holding at least a sheetlike object, wherein said decorative and functional fixture comprises:

a front fixture having a substantially flat supporting surface at a rear side, wherein at least a rail groove is vertically extended on said supporting surface, said rail groove having a deeper top recessed area at a top end, a shallower bottom recessed area at a bottom end, and a slopping groove surface extending between said top end and said bottom end so as to define a slopping depth gradually increasing from said bottom end to said top end, wherein said slopping groove surface of said rail groove is an inclined surface and said rail groove is a concave groove defining said deeper recessed area and said shallower recessed area;

at least a holding ball having a diameter larger than said shallower recessed area at said bottom end of said rail groove, wherein said at least a holding ball is rotatably disposed in said rail groove and capable of rolling along said slopping groove surface;

a rear supporting panel, which is integrally connected to said rear side of said front fixture, having a front holding surface extending behind said rail groove and said supporting surface to define a holding gap between said front holding surface of said rear supporting panel and said supporting surface of said front fixture, wherein said holding gap opens at a bottom and two sides thereof and has a width smaller than said diameter of said holding ball, thereby a weight of said holding ball normally renders said holding ball positioning at said lower end of said rail groove and pressing against both said slopping groove surface thereof and said front holding surface of said rear supporting panel by means of gravity, wherein said rear supporting panel comprises a holding panel which has a front surface forming said front holding surface and a back surface, and an affixing member which is upwardly and inwardly extended from said holding panel for attaching to said rear side of said front fixture, so as to position said holding panel parallelly right behind said supporting surface and said rail grooves provided on said supporting surface, wherein a surface of said holding ball, said slopping groove surface, said supporting surface, and said front holding surface are rough surfaces to increase friction with said holding ball; and a mounting means for attaching said rear supporting panel onto a vertical or slanted supporting surface.

2. A decorative and functional fixture that is capable of functioning as a sheetlike object hanger for vertically holding at least a sheetlike object, wherein said decorative and functional fixture comprises:

a front fixture having a substantially flat supporting surface at a rear side;

a rear supporting panel having a front holding surface, wherein at least a rail groove is vertically extended on said front holding surface, said rail groove having a deeper recessed area at a top end, a shallower recessed area at a bottom end, and a slopping groove surface extending between said top end and said bottom end so as to define a slopping depth gradually increasing from said bottom end to said top end, wherein said slopping groove surface of said rail groove is an inclined surface, and said rail groove is a concave groove defining said deeper recessed area and said shallower recessed area, wherein said rear supporting panel is integrally connected to said rear side of said front fixture so as to enable said supporting surface extending in front of said rail groove and said supporting surface to define a holding gap between said front holding surface of said rear supporting panel and said supporting surface of said front fixture, wherein said holding gap opens at a bottom and two sides thereof, wherein said rear supporting panel comprises a holding panel which has a front surface forming said front holding surface and a back surface, and an affixing member which is upwardly and inwardly extended from said holding panel for attaching to said rear side of said front fixture, so as to position said holding panel parallelly right behind said supporting surface of said front fixture;

at least a holding ball having a diameter larger than said shallower recessed area at said bottom end of said rail groove, wherein said at least a holding ball is rotatably disposed in said rail groove and capable of rolling along said slopping groove surface; said holding ball having a diameter larger than a width of said holding gap, thereby a weight of said holding ball normally renders said holding ball positioning at said lower end of said rail groove and pressing against both said slopping groove surface thereof and said supporting surface of said front fixture by means of gravity, wherein a surface of said holding ball, said slopping groove surface, said supporting surface, and said front holding surface are rough surfaces to increase friction with said holding ball; and a mounting means for attaching said rear supporting panel onto a vertical or slanted supporting surface.

* * * * *